United States Patent [19]

Yamashita

[11] 4,345,443

[45] Aug. 24, 1982

[54] APPARATUS FOR LOWERING THE TEMPERATURE OF ARTICLES

[75] Inventor: Shunroku Yamashita, Takatsuki, Japan

[73] Assignee: Kibun Co., Ltd., Tokyo, Japan

[21] Appl. No.: 233,283

[22] Filed: Feb. 10, 1981

[30] Foreign Application Priority Data

Feb. 16, 1980 [JP] Japan ..... 55-18160

[51] Int. Cl.[3] ..... F25D 25/04

[52] U.S. Cl. ..... 62/380; 62/441

[58] Field of Search ..... 62/63, 380, 440, 441

[56] References Cited

U.S. PATENT DOCUMENTS 3,455,120 7/1969 Schlemmer ..... 62/380

3,841,109 10/1974 Cann ..... 62/380

3,886,762 6/1975 Rothstein et al. ..... 62/380

4,164,129 8/1979 Stueber ..... 62/380

*Primary Examiner*—Ronald C. Capossela

*Attorney, Agent, or Firm*—Wenderoth, Lind & Ponack

[57] ABSTRACT

The apparatus disclosed is for lowering the temperature of articles in order to cool, supercool or freeze the articles, and it includes a low temperature box, means for conveying the articles through the box and means for lowering temperature in the box. The low temperature box is divided into a plurality of small chambers by separate walls each of which has at least one opening through which the articles are conveyed. The separate walls are spaced from each other along the article conveying path at predetermined intervals. The temperature lowering means is adapted to lower the temperature in each of the small chambers to a desired temperature.

6 Claims, 4 Drawing Figures

APPARATUS FOR LOWERING THE TEMPERATURE OF ARTICLES

BACKGROUND OF THE INVENTION

This invention relates to an apparatus for lowering the temperature of articles so as to cool, supercool or freeze the articles, the apparatus being used for example, to freeze foods and to separate lenses from the lense supporting device, which is used while the lenses are polished, by cooling or supercooling them.

Prior art apparatuses of this kind have in common a low temperature box within which the temperature is kept at a predetermined low value so that the articles introduced into the box are cooled to the predetermined low temperature. The following two ways are used to lower the temperature in the box.

The first way is the so called "air-blast cooling or freezing method" in which the air in the box is forcibly circulated through a heat exchanger so that the air cooled or supercooled by the heat exchanger is directed to the articles. However, the heat exchanger can lower the temperature of the air to only about −50° C. at most, and thus this method is not suitable for articles which must be rapidly cooled, supercooled or frozen. For example, when foods which are at a room temperature or higher are frozen, the following problem occurs. That is, when the temperature of the food drops just a little below 0° C., it goes into a "zone of maximum ice crystal formation" in which the temperature of the food does not go down substantially further for a certain time even though the temperature of the air around them is kept at a low degree relative to the food. However, to obtain satisfactory frozen food, it is required that the time in such zone of maximum ice crystal formation be made as short as possible. However, with the air-blast method described above, the temperature difference between the food and the air around it is about −50° C. at most, so this limits the shortening of this time period.

In the second way, a liquefied gas is sprayed in to the low temperature box. This method can lower the temperature of the air in the box to about −120° C. or lower. Thus, this method can overcome the problem existing in the air-blast method as described above. However, this method involves other problems. That is, the low temperature box has a relatively large space so that a large number of article can be treated at once and thus a large quantity of liquefied gas is required to lower the temperature of the air in the box. However, liquefied gas is expensive, so the operating cost is much higher than that of the air-blast method. Further, although the greater the temperature difference between the food and the air around it, the greater the rate of freezing the food, the acceleration of the rate decreases as the temperature difference becomes greater, so that it is not efficient to freeze the food at such a very low temperature from the beginning to the end of the freezing operation. Furthermore, in connection with frozen food, although rapid freezing is required when the temperature of the food falls into the "zone of maximum ice crystal formation" so as to shorten the time spent in the zone to improve the quality of the frozen food, the quality does not have any substantial relation with the freezing rate at temperatures of the food other than that in the "zone of maximum ice crystal formation". Accordingly, it is not necessary to place the food in the very low temperature atmosphere as noted above throughout the freezing operation. Further, the surface of certain kinds of articles tends to crack upon rapid cooling, supercooling or freezing.

SUMMARY OF THE INVENTION

Accordingly, it is an object of the present invention to provide an apparatus in which the temperature of the articles is properly lowered taking into consideration the temperature of the articles.

Another object of the invention is to provide a temperature lowering apparatus for articles the running cost of which is low.

A further object of the invention is to provide an apparatus in which the articles are rapidly cooled, supercooled or frozen properly.

A still further object of the invention is to provide an article temperature lowering apparatus in which both the airblast cooling or freezing method and the liquefied gas supercooling or freezing method are applied.

A further object of the invention is to provide an apparatus for lowering the temperature of articles which can be installed in a relatively small space and can be operated by one operator.

In accordance with the present invention, the apparatus for lowering the temperature of articles includes a low temperature box, means for conveying the articles through the box, and means for lowering the temperature in the box. The low temperature box is divided into a plurality of small chambers by separate walls each of which has an opening through which the articles are conveyed. The separate walls are spaced from each other along the article conveying path at predetermined intervals so that the temperature lowering means can lower the temperature in each of the small chambers to a desired temperature, whereby the temperature of the articles is properly lowered taking the temperature of the articles into consideration.

In the preferred embodiment, the article conveying means includes a plurality of containers for receiving the articles each of which has a forward end wall and a rear end wall spaced in the article conveying direction and advancing means for advancing the containers through the low temperature box with the containers arranged in a row. The openings in the separate walls are aligned so that the containers can be advanced through the openings and the size and shape of the openings are made to be substantially equal to the end walls of the containers. The intervals between the separate walls are made generally a whole number of times the space between the end walls of the containers, and the container advancing means intermittently advances the containers so that when the containers are stopped the end walls of the containers generally close the openings of the separate walls, whereby the temperature of each small chamber is lowered to a desired value.

Further, the low temperature box is divided into upper and lower chambers by a horizontal partition which extends from one end wall of the box to a point short of the other end wall of the same and a vertical path is formed between the partition and the other end wall to connect the upper and lower chambers. The inlet for the articles is provided in one end wall of the box above the partition and the outlet for the articles is provided on the same end wall below the partition so that the articles are conveyed through the inlet, the upper chamber, the vertical path, the lower chamber, and the outlet, whereby the space for setting up the apparatus is kept small and the operation of the apparatus can be effected by one operator at the above mentioned one end wall of the box.

The temperature lowering means includes an air-blast cooling or freezing device provided in the small chamber in the upper chamber and having a heat exchanger for lowering the temperature of the air in the small chamber and air circulating means for circulating the air through the heat exchanging means, and further includes liquefied gas spraying means for spraying the liquefied gas into the small chamber in the lower chamber, whereby a supercooling or freezing operation is effected properly and economically.

BRIEF DESCRIPTION OF THE DRAWINGS

A better understanding of the invention may be had from the consideration of the following detailed description taken in conjunction with the accompanying drawings in which.

DESCRIPTION OF THE PREFERRED EMBODIMENT

Figure 2:
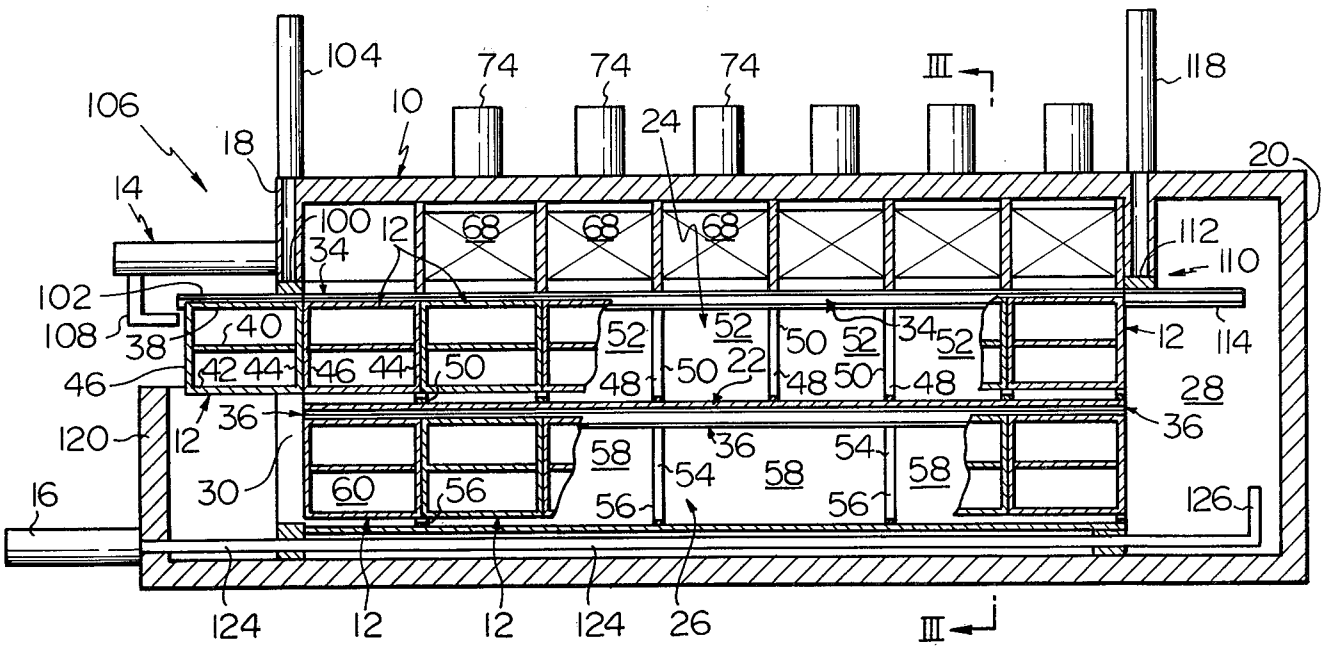
FIG. 2 is a sectional view taken along the line II—II in FIG. 3 in which a portion of a series of containers is cut away to show separate walls of the freezing box of the freezing apparatus.
Figure 3:
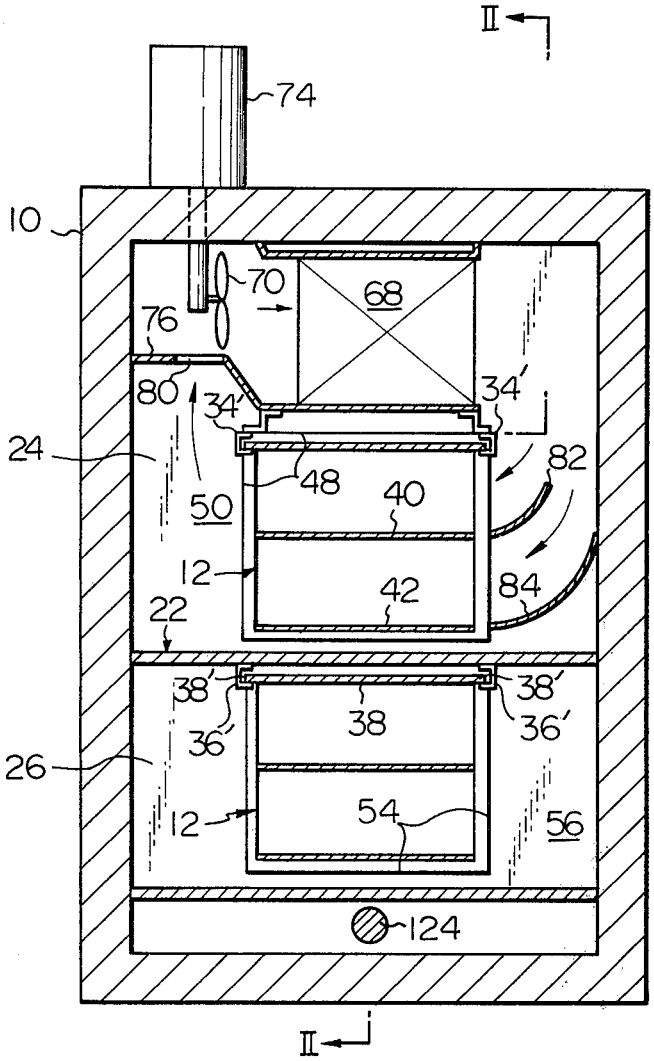
FIG. 3 is a sectional view taken along the line III—III in FIG. 2.

In the accompanying drawings, there is shown a food freezing apparatus which includes, as best shown in FIGS. 2 and 3, a freezing box 10, containers 12 adapted to receive foods to be frozen and advancing means including hydraulic cylinder-piston devices 14 and 16 which are adapted to advance a series of the containers 12 through the box 10 with the containers arranged in a row.

The freezing box 10 has an upper chamber 24 and a lower chamber 26 divided by a partition wall 22, which horizontally extends from one end wall (left end wall in FIG. 2) 18 of the box 10 to a point short of an opposite end wall (right end wall) 20, so as to have a vertical path 28 between the partition wall 22 and the right end wall 20 of the box 10 and connects the upper which lower chambers 24 and 26. The left end wall 20 of the freezing box 10 is provided with an opening 30 so that the containers 12 are advanced into the upper chamber 24 through the upper half portion (or inlet portion) of the opening 30 and are advanced out of the lower chamber 26 through the lower half portion (or outlet portion) of the same. The upper chamber 24 is provided with guide rail means 34 which is adapted to guide the containers 12 from the opening 30 to the vertical path 28 and the lower chamber 26 is provided with guide rail means 36 which is adapted to guide the containers from the vertical path 28 to the opening 30. That is, each container 12 includes an upper plate 38, an intermediate plate 40, a bottom plate 42, a forward end plate 44 and an rear end plate 46 and the guide rail means 34 and 36 respectively have a pair of channel steel members 34' and 36' which are horizontally positioned with a space therebetween generally corresponding to the width of the container 12 and the channel members 34' (36') facing each other so that the opposite side edges 28' of the upper plate 28 of the container are engaged by the corresponding channels of the channel members, whereby the container is suspended and guided by the guide members. The laterally opposite sides of the container 12 are open so that, as described in detail hereinbelow, the supercooling air can pass through the container.

The upper chamber 24 is divided into seven small freezing chambers 52, each of which accommodates just one container 12, by separate walls 50 each having an opening 48 through which the containers pass and the lower chamber 26 is divided into three small freezing chambers 58, each of which accommodates just two containers, and one small freezing chamber 60, which accommodates just one container, by separate walls 56 each having an opening 54 through which containers pass. The openings 48 and 54 of the separate walls 50 and 56 have generally the same size and shape as that of the end plates 44 and 46 of the container 12, so that, when the end plates of the container are positioned at the opening 48 or 54, the opening is generally closed by the end plates 44 and 46 and the passing of air between the adjacent small freezing chambers is generally prevented. The opening 30 provided in the left end wall 18 of the freezing box has a shape and size generally corresponding to that of two stacked end plates of the container 12 so that leakage of cooling air from the opening 30 is minimized. Although the embodiment shown in the accompanying drawings does not have seal members, such may be provided on the periphery of the opening 30 to engage the end plate of the container 12 so as to reduce the leakage of the cooling air.

Figure 1:
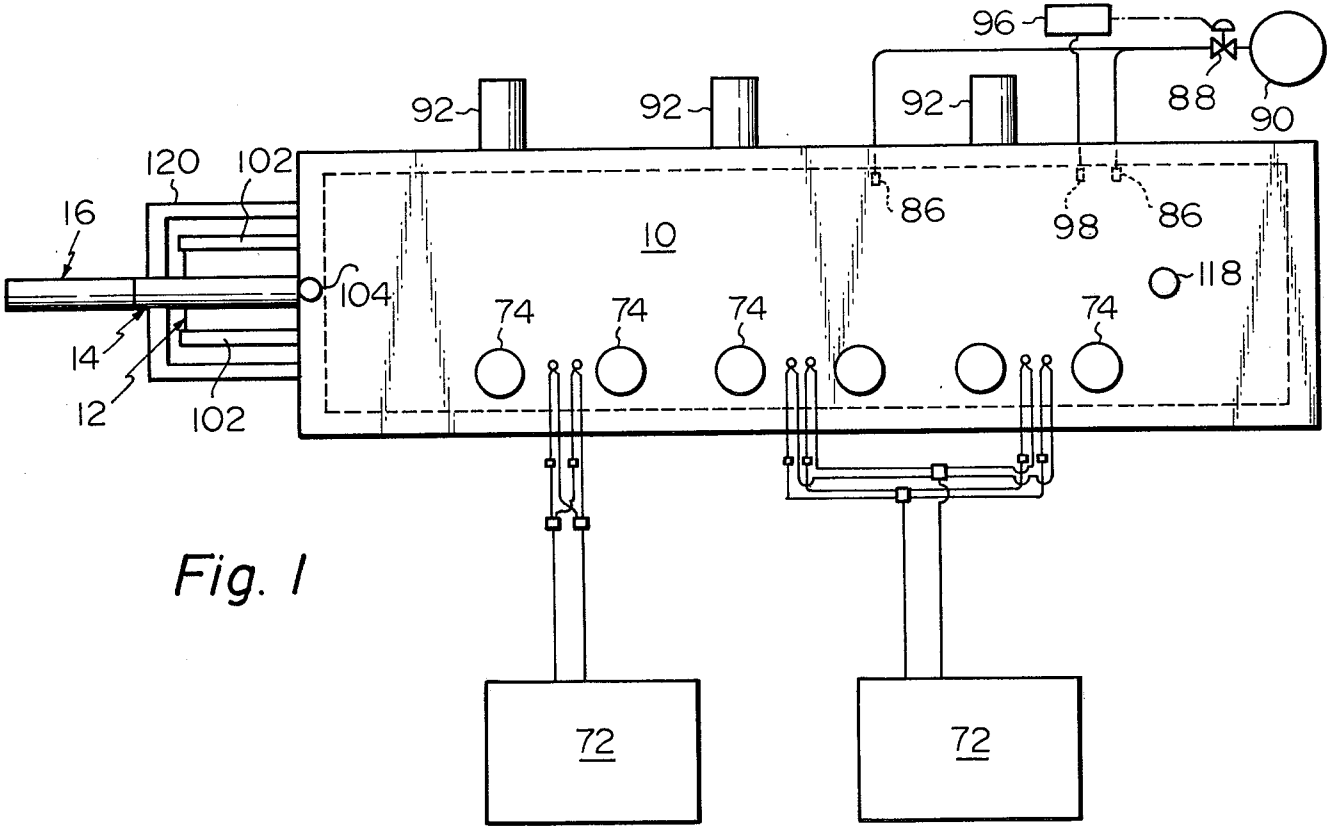
FIG. 1 is a plan view of a food freezing apparatus in accordance with an embodiment of the invention.
Figure 4:
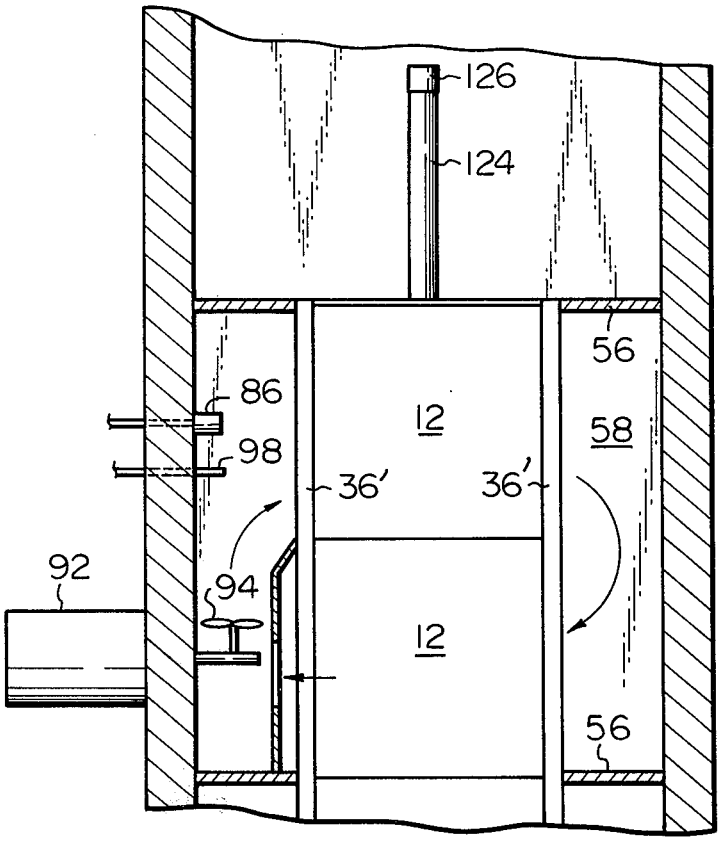
FIG. 4 is a fragmentary sectional plan view of the freezing apparatus showing a vertical path and a small freezing chamber.

The small freezing chambers n the upper chamber 24, except for the chamber adjacent the opening 30, respectively have a heat exchanger 68 and a fan 70 for circulating the air through the heat exchanger 68. The heat exchanger 68 is connected to a compressor 72 provided outside the freezing box 10 so as to receive coolant such as R-22 ($CHClF_2$) so that it can supercool the air in the chamber to around −50° C. and each fan 70 is adapted to be driven by a motor 74 provided outside the freezing box so that the air in the chamber is forcibly circulated through the heat exchanger 68, the container 12 and an opening 80 in a partition 76. In FIG. 3, references 82 and 84 designate fins which direct the air from the heat exchanger 68 towards the upper and lower chambers of the container 12 divided by the intermediate plate 40. The small freezing chamber 52 adjacent the opening 30 is not provided with a device for supercooling the air in the chamber only; however, it can be supercooled by air leaked from the adjacent small freezing chamber. Further, the two small freezing chambers 58 next to the vertical path 28 each have a nozzle 86 which is, as shown in FIGS. 1 and 4, directed toward one of the two containers received in the chamber 58 which is connected to a tank 90 of liquefied gas such as liquefied nitride through a valve 88 so that these chambers can be cooled to around −120° C. by spraying liquefied gas into the chambers. Further, each of these chambers 58 includes fan 94 which is driven by a motor 92 positioned outside the freezing box 10 to forcibly circulate the vaporized nitride gas and the air cooled thereby through two containers successively. Incidentally, as shown in FIGS. 1 and 4, the small freezing chamber 58 in the lower chamber 26 adjacent the vertical path 28 is provided with a temperature detecting device 98 which is connected to a temperature controlling device 96 so that the detecting device detects the temperature of the chamber and operates the valve 88 by delivering signals thereto. The small freezing chamber 60 adjacent to the opening 30 and the small freezing chamber 58 next to the chamber 60 do not have such a nozzle system as described above; however, they are supercooled by air leaked from the upstream small freezing chambers 58 to a temperature low enough to freeze the food to the desired final temperature.

Next, there will be explained hereinbelow the advancing means for advancing the containers 12 through the upper half portion of the opening 30 into the upper chamber 24 in the freezing box, then through the vertical path 28, the lower chamber 26 and the lower half portion of the opening 30 and bringing them back to the upper half portion of the opening 30. The advancing means has a lift 106 provided at the left end wall 18 of the box including a pair of container engaging rails 102 connected by a horizontal lateral connecting bar 100, said rails being spaced from each other the same distance as that between channel members 34' 36 of each guide means 34 and 36 and adapted to engage and suspend one container 12, and hydraulic cylinder-piston device 104 connected to the center of the connecting bar 100 so as to move the engaging rails up and down. The container engaging rails 102 are adapted to be aligned with the channel members 34' at the uppermost position thereof and are also adapted to be aligned with the channel members 36' at the lowermost position. The hydraulic cylinder-piston device 14 for advancing the container 12 suspended by the lift 106 into the upper chamber 24 through the upper portion of the opening 30 is provided on the left end wall 18 of the freezing box 10 and has a pushing member 108 connected to the piston rod (not shown). The pushing member 108 is adapted to move between the engaging rails 102 towards the left end wall 18 so that the container 12 suspended by the lift 106 is advanced into the upper chamber 24 through the opening 30 by operating the cylinder-piston device 14 to move the pushing member 108 towards the left end 18 when the container is suspended by the lift 106. The containers in the upper chamber 24 and the container suspended by the lift 106 are in contact with one another and thus all of the containers in the upper chamber 24 are advanced when one container suspended by the lift 106 is advanced. Further, in the vertical path 28, a lift 110 is provided the construction of which is similar to that of the lift 106. That is, the lift 110 includes a pair of container engaging rails 114 connected by a horizontal lateral connecting bar 112, and which are spaced from each other the same distance as that of guide members 34' and 36' of each guide means 34 and 36 and adapted to engage and suspend one container 12, and hydraulic cylinder-piston device 118 connected to the center of the connecting bar 112 so as to move the rails up and down. The container engaging rails 114 are adapted to be aligned with the channel members 34' at the uppermost position and also adapted to be aligned with the channel members 36' at the lowermost position, whereby the container engaging rails 114 can engage and suspend the container positioned at the head of the line of the containers in the upper chamber 24 when the containers are advanced by the hydraulic cylinder-piston device 14. Further, at the bottom portion of the left end wall 18 of the freezing box 10, a wall 120 having an "L" shaped cross section is provided and the hydraulic cylinder-piston device 16 is provided on this wall. The hydraulic cylinder-piston device 16 has a piston rod 124 which extends through the bottom of the freezing box 10 into the vertical path 28 and has a pushing member 126 provided on the right end of the piston rod 124. Thus, after the rails 114 of the lift 110 engaging one container are lowered to the lowermost position, the hydraulic cylinder-piston device 16 is operated to move the piston rod 124 leftwardly in FIG. 2, so that the container suspended by the lift 110 is moved into the lower chamber 26 to thereby advance the containers suspended by the guide means 36 and thus the leftmost container 12 therein is advanced out of the box 10 through the lower portion of the opening 30 to thereby be engaged by the lift 106 positioned at the lowermost position.

The operation of the hydraulic cylinder-piston devices 104, 118 and 14, 16 is timed as follows. First, the hydraulic cylinder-piston device 104 of the lift 106 lifts the container engaging rails 102 to their uppermost position and at the same time the hydraulic cylinder-piston device 118 of the lift 110 lifts the container engaging rails 114 to the uppermost position. In such condition, the hydrualic cylinder-piston device 14 is operated to advance the container 12 suspended by the lift 106 into the upper chamber 24. As a result of this operation, the rightmost container 12 in the upper chamber 24 is moved into the lift 110 and is engaged by the rails 114. When the hydraulic cylinder-piston device 14 is retracted to the initial position, the hydraulic cylinder-piston devices 104 and 118 of the lifts 106 and 110 are operated to lower their container engaging rails 102 and 114 to the lowermost position. Then, the hydraulic cylinder-piston device 16 is operated to move the piston rod 124 and thus the pushing member 126 leftwardly so that the container suspended by the lift 110 is moved leftwardly into the lower chamber 26 to be engaged by the guide rail means 36 and at the same time the leftmost container in the lower chamber 26 is moved out of the chamber through the opening 30 to be engaged by the lift 106. After this operation, the hydraulic cylinder-piston devices 104 and 118 of the lift 106 and 110 are operated to lift the container engaging rails 102 and 114 to the uppermost position and thus the food freezing apparatus returns to the initial condition.

In operation, food to be frozen is previously placed on trays (not shown) and these trays are positioned on the intermediate plate 40 and the bottom plate 42 of the container suspended by the lift 106. After the trays are conveyed through the freezing box and returned to the initial position, i.e., the uppermost position of the lift 106, they are removed from the container. As stated hereinbefore, it is required that the time period of "the zone of maximum ice grystal formation" be made as short as possible. For this requirement, in the embodiment shown in the drawings, the foods are initially cooled to about 0° C., near the "zone of maximum ice crystal formation", in the upper chamber 24 and then the foods are rapidly frozen and supercooled to a predetermined temperature lower than that of "zone of maximum ice crystal formation" in the two small freezing chambers 58 next to the vertical path 28 by liquefied nitride and are further supercooled to a desired or final low temperature in the following small freezing chambers 58 and 60. As noted from the description of the operation of the advancing means, the containers 12 are intermittently advanced and, when they are stopped, the end plates 44 and 46 thereof are adapted to generally close the openings of the separate walls 50 and 56 so that movement of air between the adjacent chambers is generally prevented, whereby these small freezing chambers can be set at desired different temperature.

In the foregoing only one embodiment of the invention has been described, but the invention is not limited to this embodiment. For example, although in the illustrated embodiments, the temperatures in the small chambers other than those in which liquefied gas is sprayed or an air-blast type freezing device is provided are controlled by low temperature gas leaked from the latter small chambers, they can be controlled in other ways. For example, nozzles for spraying liquefied gas can be provided in each small chamber and the temperature in each of these small chambers can be controlled by controlling the volume of liquefied gas sprayed into the chambers. Further, the articles can be intermittently or continuously conveyed by conventional endless conveyer means. Furthermore, the articles on the conveyers can be advanced with the containers arranged in a plurality of rows. The conveyors can be guided by rail means located beneath the containers.

What is claimed is:

1. An apparatus for lowering the temperature of articles in order to cool, supercool or freeze the articles, comprising: a low temperature box, said box having separate walls therein and dividing said box into a plurality of small chambers, said walls each having at least one opening therein for passage therethrough of the articles to be cooled, said separate walls being spaced from each other along an article conveying path at predetermined intervals with the openings therein aligned; means for lowering the temperature in each of said small chambers to a desired temperature; and article conveying means for conveying articles along said article conveying path through said openings, said article conveying means including a plurality of successive containers for receiving the articles and each having a forward end wall and a rear end wall substantially the same size as said openings, said intervals between said separate walls being substantially a whole number of times the space between said forward and rear end walls of said containers, and advancing means for intermittently advancing the containers through said box with the containers arranged in at least one row, and for stopping the containers with said end walls of the containers generally close to and substantially filling the openings of said separate walls, whereby leakage of cooled gas between the chambers is substantially prevented and the temperature in each of said small chambers can be accurately controlled to a desired value.

2. An apparatus according to claim 1 wherein there is a plurality of rows of containers and said container advancing means comprises means for advancing said rows of containers simultaneously.

3. An apparatus according to claim 1 wherein there is a plurality of rows of containers and said container advancing means comprises means for advancing said rows of containers individually.

4. An apparatus according to claim 1 wherein said temperature lowering means includes means for spraying liquefied gas into at least one small chamber for rapidly supercooling the articles in said small chamber.

5. An apparatus according to claim 1 wherein said temperature lowering means includes means for spraying liquefied gas into at least one small chamber and air-blast type freezing means for supplying cooled air to at least one other small chamber and including a heat exchanger for supercooling the air and circulating means for circulating the air through the heat exchanger, said air-blast type freezing means being positioned upstream of said article conveying path relative to said small chamber into which liquefied gas is sprayed.

6. An apparatus according to claim 1 wherein said low temperature box includes an upper chamber and lower chamber, a horizontal partition separating said chambers and extending from one end wall of said box toward and terminating short of the other end wall of the box for leaving a vertical path between the partition and said other end wall which connects said upper and lower chambers, and said one end wall of said box having an inlet for containers above said partition and an outlet for said containers below said partition, said container advancing means being positioned to advance the containers through said inlet, said upper chamber, said vertical path, said lower chamber and then said outlet, said upper chamber having at least one first small chamber, said lower chamber having at least one second small chamber, said temperature lowering means including an air-blast type freezing device connected to said at least one first small chamber in said upper chamber and including a heat exchanger for lowering the temperature of the air in said first small chamber and air circulating means for circulating said air in said first small chamber through said heat exchanger, and said temperature lowering means further including means for spraying liquefied gas into said at least one small second chamber in said lower chamber.

* * * * *